United States Patent [19]

Keith

[11] 4,197,861

[45] Apr. 15, 1980

[54] SMOKING MATERIAL

[75] Inventor: Charles H. Keith, Charlotte, N.C.

[73] Assignee: Celanese Corporation, New York, N.Y.

[21] Appl. No.: 589,957

[22] Filed: Jun. 24, 1975

[51] Int. Cl.[2] ..... A24D 1/18; A24B 15/02

[52] U.S. Cl. ..... 131/2; 131/15 R; 131/17 R; 131/140 B

[58] Field of Search ..... 131/2, 140 C, 17 R, 131/143, 15 C, 140 C, 140 B, 17

[56] References Cited

U.S. PATENT DOCUMENTS

| | | | |
|---|---|---|---|
| 2,029,494 | 2/1936 | Loewenthal | 131/143 |
| 3,638,660 | 2/1972 | Davis | 131/2 |
| 3,897,793 | 8/1975 | Webster | 131/2 |
| 3,931,824 | 1/1976 | Miano et al. | 131/2 |

OTHER PUBLICATIONS

"Tobacco & Tobacco Smoke" Studies in Experimental Carcinogenesis by Wynder et al., Publ. 1967, Academic Press N.Y. & London, p. 350, Table 9 cited.

"The Chemistry and Technology of Tobacco" vol. 3, by Schmuck Published by Pishchepromizdat Moscow, 1953, Call No. Sb 275 S5 C. 2 pp. cited 602–603 & 461.

*Primary Examiner*—V. Millin

*Attorney, Agent, or Firm*—Andrew F. Sayko, Jr.

[57] ABSTRACT

An improved synthetic material adapted for use in smoking products is prepared by intimately mixing a suitable matrix material with a combustion modifier and a minor amount of an alkali metal or alkaline earth metal salt of an organic acid.

7 Claims, No Drawings

SMOKING MATERIAL

The present application, which is a continuation of Ser. No. 501,941, filed Aug. 30, 1974, now abandoned, which in turn is a continuation of Ser. No. 234,350, filed Mar. 13, 1972, now abandoned, which in turn is a continuation-in-part of application Ser. No. 842,032, filed July 15, 1979 now abandoned, relates generally to smoking products and more specifically to synthetic materials suitable as tobacco substitutes.

Many attempts have been made to produce a commercially acceptable substitute for tobacco. Generally, these attempts have been unsuccessful. The lack of success of tobacco substitutes has been in many instances attributable to the undesirable taste and odor of the substitute. Also, previous substitutes have tended to deliver significant amounts of undesirable pyrolysis products.

Commonly assigned U.S. Ser. No. 696,699, filed Jan. 10, 1968, now abandoned, and incorporated herein by reference, describes a tobacco substitute largely alleviating the above deficiencies. Generally, the synthetic material described is comprised of a non-toxic film-forming matrix containing a combustion modifier, with the matrix and modifier being combined in a weight to weight ratio of from about 85:15 to about 15:85.

More specifically, the matrix materials described are selected from the group consisting of starch, and starch and cellulose derivatives including salts thereof containing the recurring anhydroglucose unit

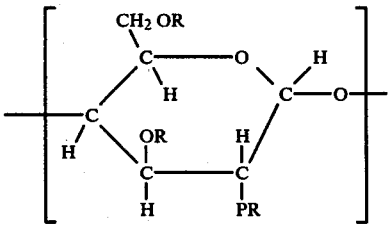

wherein at least one R is selected from the group consisting of lower alkyl, hydroxy lower alkyl, carboxy lower alkyl groups, and mixtures thereof, and the remaining R's are hydrogen atoms. Preferably, R is selected from the group consisting of $CH_2COOM$, $CH_2CH_2OH$ and $CH_3$; in which M is a non-toxic cation or hydrogen, and preferably is selected from the group consisting of alkali metal and alkaline earth metals, aluminum, iron, and hydrogen. Compounds of the above nature ordinarily have an average degree of substitution for hydrogens of from about 0.2 to about 3.0 R groups per unit, and preferably have from about 0.4 to about 1.2 groups per unit. Mixtures of these compounds are also described as being suitable.

Matrix materials described as particularly suitable are carboxymethyl cellulose, hydroxyethyl cellulose, carboxymethyl hydroxyethyl cellulose, methyl cellulose, carboxymethylated starch and the like.

The combustion modifiers employed are described generally as non-toxic particulate materials, preferably having an average minimum dimension of from about 0.2 microns to about 1.0 millimeter, and even more preferably an average minimum dimension of from about 0.2 microns to about 0.5 millimeters. It is also preferred that the particulate materials have a maximum dimension of from about 0.25 mm, and more preferably, about 0.10 mm.

Suitable combustion modifiers can be selected from organic compounds, inorganic compounds and the elements, so long as the material is non-toxic, i.e., pharmacologically inactive in the sense of significant adverse effects in a causative relationship upon oral ingestion of the substance itself or its combustion products. Preferred results are obtained using inorganic compounds.

Inorganic compounds suitable as fillers preferably consist of a cation selected from Column (A) and an anion selected from Column (B).

| (A) | | | (B) |
|---|---|---|---|
| Lithium | Manganese | Silicon | Oxides |
| Sodium | Aluminum | Palladium | Hydrated Oxides |
| Potassium | Cerium | Tin | Hydroxides |
| Cesium | Cobalt | Zinc | Carbonates |
| Magnesium | Iron | Titanium | Phosphates |
| Calcium | Molybdenum | Zirconium | Aluminates |
| Strontium | Nickel | Copper | Stannates |
| Barium | Rubidium | | Zincates |
| | | | Silicates |
| | | | Carbides |

The most preferred inorganic compounds are the alkali metals and alkaline earth metal carbonates, oxides, silicates, aluminosilicates, aluminates, and aluminum hydroxide. Inorganic compounds in their naturally occurring state, such as dolomite, perlite, magnesite, diatomaceous earth, vermiculite, etc., are also suitable.

In order to obtain a smouldering rate comparable to tobacco, the aforesaid ingredients are generally combined in a ratio of from about 85:15 to about 15:85, and preferably, in a ratio of from about 25:75 to about 75:25. Combination of these materials and these ratios generally yields a material having a smouldering rate comparable to tobacco when smoked under analogous conditions; that is, about 3–10 mm/minute in conventional cigarette form. A smouldering rate of this magnitude corresponds to a puff count of about 12–5 in a cigarette smoked on a 60 second cycle.

While tobacco substitutes of the above nature show substantial improvements over other prior art substitutes, further improvement in taste, odor and amount of components delivered in the smoke stream is still desirable.

It is, therefore, an object of the present invention to provide a process for preparing an improved tobacco substitute which exhibits improved taste and odor properties and reduced component delivery.

It is another object to provide an improved tobacco substitute which exhibits improved taste and odor properties and reduced component delivery.

Other objects of the present invention, if not specifically set forth herein, will be obvious to the skilled artisan upon reading of the following detailed description.

Generally, it has been found that improved tobacco substitutes can be prepared by combining a minor amount of an alkali metal or alkaline earth metal salt of an organic acid to tobacco substitutes of the type described in U.S. Ser. No. 696,699 now abandoned.

More specifically, the present invention is directed to tobacco substitutes comprising a film of a matrix material and a combustion modifier as previously described having incorporated therein up to about 5%, and preferably from about 0.5 to about 2.0%, by weight of the substitute of an alkali metal or alkaline earth salt of an organic acid.

Salts preferred in the present invention are those having a melting point below 350° C. and aqueous tensions over saturated aqueous solutions of less than 12 mm of mercury. Specific compounds include the potassium, lithium and magnesium salts of formic, propionic, oxalic, malonic, lactic, malic, citric and tartaric acids. Potassium acetate is especially preferred in the present invention.

The present tobacco substitutes are prepared by intimately mixing the matrix, filler and salt water and forming a film from the mixture. Ordinarily, the mixture at the time of film formation, e.g. by casting, will contain from about 65 to 95% water, although percentages of water outside this range can be used. The film is then dried, usually by passing through a heating zone. Film forming conditions are ordinarily controlled to produce a film having a dried thickness of about 2–20, preferably 5–7 mils.

The following example is presented as illustrative of the present invention and is not to be taken as in limitation thereof.

EXAMPLE

| Ingredient | Parts by Wt. |
|---|---|
| Carboxymethyl cellulose | 12 |
| Dolomite | 12 |
| Diatomaceous earth | 10 |
| Carbon | 0.4 |
| Wetting agent | 0.6 |
| Humectant | 0.6 |
| Wet strength resin | 1.2 |
| Coloring agent | 0.18 |

A second mixture was prepared by combining the above materials with 1% by weight of potassium acetate.

The mixtures, which contained approximately 85% water, were cast into films which were then dried. The dried films, which had a thickness of 5–7 mils, were cut into shreds of about 1.0 cm in length and 0.9 mm in width and formed into cigarette-like smoking columns of 85 mm in length and 8 mm in diameter. Each smoking column contained 1.1 g of tobacco substitute.

Smoking columns thus prepared were smoked on an apparatus which took 35 ml. puff over a 2 second interval on a 60 second cycle. Pressure drop, i.e., the flow resistance occurring when air was drawn through the column at the rate of 1050 ml/min. was determined. Tar weight was obtained by drawing the smoke from the cigarette through a Cambridge filter pad which removed 98% of the solid particulate matter and weighing the pad before and after smoking. The amount of the gas phase components was determined by chromatographic analysis. Puff count is defined as the number of puffs required to smoke the column to a 30 mm butt.

The following table sets forth the results obtained in comparison with the results from smoking a standard all-tobacco column of equal weight and size.

TABLE

| Property | Tobacco | Substitute | Substitute 1% Potassium Acetate |
|---|---|---|---|
| Puff count | 10.0 | 7.1 | 9.5 |
| Pressure drop | 70.0 | 38.0 | 37.0 |
| Wet particulate matter, (tar), mg/cig. | 28.7 | 2.8 | 2.7 |

TABLE-continued

| Property | Tobacco | Substitute | Substitute 1% Potassium Acetate |
|---|---|---|---|
| Water, mg/cig. | 4.0 | 1.1 | 2.1 |
| Dry particulate matter, mg/cig. | 24.7 | 1.7 | 0.0 |
| Methanol, μg/puff | 12.8 | 1.4 | 0.4 |
| Acetaldehyde, μg/puff | 47.8 | 41.5 | 24.5 |
| Furan, μg/puff | 3.1 | 0.7 | 0.5 |
| Propionaldehyde, μg/puff | 4.1 | 2.9 | 1.5 |
| Acetone, μg/puff | 28.2 | 14.3 | 7.2 |
| Benzene, μg/puff | 7.1 | 1.5 | 1.2 |
| Benzo(α) pyrene | 2.4 | 1.2 | 1.0 |

In addition to the significantly reduced deliveries shown by the above table, there was a noticeable improvement in the taste of the substitute containing the potassium acetate over that of the untreated substitute. As shown above, the modified substitute is slower burning and has a more desirable moist smoke.

Surprisingly, the addition of 1% potassium acetate to tobacco produced no desirable change in the smoke chemistry or taste. Also, the addition of 1% lithium chloride to the substitute produced no change other than imparting a slight irritation to the smoke stream.

While not wishing to be held to a particular theory, it is believed that the addition of the presently claimed additives to the hereindefined substitutes produces in noted improvements in two ways. First, there is an addition of excess water into the smoke stream by the dehydration of the salt during the smoking process, thereby providing a more moist, less irritating smoke stream. Second, there appears to be a fusing or fluxing action of the additive and inorganic fillers which impedes the flow of combustion and pyrolysis products into the main stream smoke.

Although the present substitutes have been described as being a combination of a matrix, a combustion modifier and the claimed additive, it is to be understood that additional materials may also be added in minor amounts. These option materials include, without limitation, ash modifiers, such as fiberglass and organic fibers; flavor and odor modifiers, such as tobacco extracts, synthetic flavors or sugars; coloring agents, such as carbon, food dyes and inorganic pigments; plasticizers and humectants, such as butylene glycol, glycerol and propylene glycol; and wetting agents.

Formulations may be prepared entirely from nontobacco materials. If desired, tobacco can be added to the formulation. If tobacco is incorporated into the sheet, e.g., in the form of tobacco dust, amounts up to 40% can be used without detriment to sheet coherency. Preferably, the sheet will contain from 0 to 30% tobacco dust. In addition, the sheet material can be combined in any desired combination with tobacco, reconstituted tobacco, or other tobacco substitutes in the ultimate smoking product.

While the present invention has been described with specific illustrations, it is to be understood that many modifications may be made thereto without departing from the spirit and scope thereof.

Having thus disclosed the invention, what is claimed is:

1. A smoking material comprising a combustible organic ingredient, a particulate inorganic filler and from 0.2 to 5% of an alkali metal or alkaline earth metal salt of an organic acid, the major proportion of said combustible organic ingredient being a material selected from the group consisting of film-forming cellulose derivatives, their salts and mixtures thereof having the recurring anhydroglucose unit:

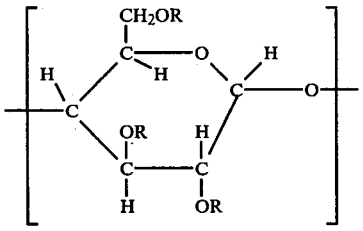

wherein at least one R is selected from the group consisting of lower alkyl, carboxy lower alkyl, hydroxy lower alkyl groups and mixtures thereof; and the remaining R's are hydrogen and the average degree of substitution is from about 0.2 to 3.0; said major portion of said combustible organic ingredient and said particulate inorganic filler being present in a weight-to-weight ratio of 15:85 to 35.3:64.7.

2. The smoking material of claim 1 wherein said major proportion of said combustible organic ingredient is selected from the group consisting of carboxymethyl cellulose, carboxymethyl cellulose salts, carboxyethyl cellulose, hydroxyethyl cellulose, hydroxypropyl cellulose, carboxymethyl hydroxyethyl cellulose and mixtures thereof and said particulate inorganic filler is selected from the group consisting of titanium dioxide, magnesium oxide, silica gel, sodium silicate, sodium alginate, zinc oxide, aluminum oxide, ferric oxide, calcium aluminate, silica aluminate, calcium carbonate, diatomaceous earth, dolomite, carbon, perlite, magnesite, zeolite, vermiculite and mixtures thereof.

3. The material of claim 1 wherein the organic acid salt is selected from the group consisting of the alkali metal and alkaline earth metal salts of formic, acetic, propionic, oxalic, malonic, lactic, malic, citric, and tartaric acids, and mixtures thereof.

4. The material of claim 1 wherein said salt is present in an amount of from about 0.5 to about 2.0% of the composition.

5. The material of claim 1 wherein said salt is potassium acetate.

6. The material of claim 1 in the form of a film having a thickness of from about 2 to about 20 mils.

7. The smoking material of claim 6 wherein said salt is selected from the group consisting of potassium, lithium and magnesium salts of acetic, formic, propionic, oxalic, malonic, lactic, malic, citric and tartaric acids.

* * * * *